United States Patent [19]

Blair et al.

[11] 4,363,411

[45] Dec. 14, 1982

[54] HAMMERHEAD CRANE WITH PLURAL SHUTTLE TROLLEYS, A LOAD TROLLEY AND MOVABLE COUNTERWEIGHT MEANS

[75] Inventors: Gilbert Blair; Roy A. Behling, both of Coraopolis; Richard Collins, Allison Park, all of Pa.

[73] Assignee: Dravo Corporation, Pittsburgh, Pa.

[21] Appl. No.: 921,787

[22] Filed: Jul. 3, 1978

[51] Int. Cl.[3] ..... B66C 23/52

[52] U.S. Cl. ..... 212/191; 414/138; 212/195; 212/198; 212/225

[58] Field of Search ..... 414/138; 212/3, 48–49, 212/56, 61, 63, 71, 190, 191, 194, 195–198, 223–225, 210, 211, 218, 219

[56] References Cited

U.S. PATENT DOCUMENTS

| | | | |
|---|---|---|---|
| 3,381,826 | 5/1968 | Durand | 212/48 |
| 3,994,401 | 11/1976 | Ray et al. | 212/56 |
| 4,039,086 | 8/1977 | Ray | 212/47 |
| 4,067,446 | 1/1978 | Ray | 212/48 |
| 4,113,112 | 9/1978 | Ray | 212/71 |

*Primary Examiner*—Trygve M. Blix
*Assistant Examiner*—R. B. Johnson
*Attorney, Agent, or Firm*—Parmelee, Miller, Welsh & Kratz

[57] ABSTRACT

A hammerhead type of crane has a structural tower with opposed structural cantilevers extending horizontally therefrom and there is a horizontal track along which a load carrying trolley may move through the tower between limits near the outer ends of the cantilevers and a second horizontal track along which a counterweight may travel at the same speed and distance but in the opposite direction and with the load trolley and counterweight passing each other as they move through the tower from one cantilever to the other. The counterweight is moved by means of a cable that has its opposite ends attached to the counterweight and which between its ends is wound about a reversible drum arranged to selectively move the counterweight in one direction or the other. For moving the load trolley in a direction opposite to but at the same speed, a system of cables connected with the counterweight is provided which includes a shuttle trolley on each cantilever arranged to move in the same direction as the load trolley but at half the speed, while other cables transmit motion between the load trolley and the slower-moving shuttle trolleys. This arrangement (a) avoids many long unbroken spans of cables otherwise commonly used and reduces the hazards of an accident, (b) provides the opportunity of direct reeving of the bucket hold and close lines, and (c) reduces sag tension at the bucket, thereby reducing the bucket weight requirements and thus permitting greater payload.

11 Claims, 3 Drawing Figures

HAMMERHEAD CRANE WITH PLURAL SHUTTLE TROLLEYS, A LOAD TROLLEY AND MOVABLE COUNTERWEIGHT MEANS

This invention is for a material handling crane of the type usually identified as a "hammerhead" crane. It is commonly, but by no means exclusively, used for transferring bulk material from a barge or ship to shore, or vice versa. As generally constructed, it has a structural steel tower with opposed horizontal arms or structural cantilevers projecting therefrom, one of which may extend from the dock out over a ship or barge anchored alongside the crane. The other cantilever may then extend landward to a storage pile, train of cars, conveyor or perhaps over a receiving barge or ship in a slip at the other side of the dock. The crane, therefore, is roughly the shape of a letter "T" and, with its vertical column and the diagonal braces for the cantilevers, its contour resembles that of a hammer, from which the name "hammerhead" is derived.

The lower part of the tower may include a turntable to enable the upper part of the tower with its cantilever arms to be turned about the vertical axis of the tower, or in the parlance of the industry, to be "slewed." This turntable is generally mounted on a base structure or gantry movable along special rails. At selected positions the gantry may be releasably clamped against movement. The rails provide a track to allow the crane to travel along a dock or such other places as the crane may be used.

Generally, these cranes are quite massive with the range of travel of the load carrying trolley, or "load trolley," being several hundred feet, the particular one in the drawings hereinafter referred to having a range of travel from adjacent the outer end of one cantilever to the outer end of the other of about 600 feet (183+ meters). This is not critical, except that the drawings, being on such a small scale, convey little impression of the magnitude of the forces tending to topple the tower if a severe condition of unbalance should arise.

Various schemes have been devised for counteracting or compensating for the changing conditions of imbalance and unequal stress conditions which are encountered with each cycle of operation of the load trolley and its bucket or other load raising, transporting and unloading means.

We are aware that some attempts toward equalizing the stresses are used and are satisfactory with relatively small unloading cranes, but which for various reasons, one of which is the great length of cables for racking the trolley and the hazards of breaking under certain conditions, would result in unsafe or dangerous movement of both the load trolley and the counterweight to the same end of one of the two opposed cantilevers, with possible injury to workers.

According to the present invention, there are upper and lower horizontal trolley tracks extending from a limit or terminal near the outer end of one cantilever to a limit or terminal near the outer end of the other cantilever. There is a counterweight movable horizontally along the upper track. There is a "machinery house" at the top of the tower above the tracks. In the machinery house there is a reversible power-driven racking drum of usual construction around which a racking cable, preferably actually comprising two oppositely extending sections but, for simplicity, here illustrated and described as a single length, is looped several times. The two ends of the racking cable, as so illustrated, extend in opposite directions, one around a sheave adjacent the outer end of one cantilever structure and one around a sheave adjacent the outer end of the other cantilever structure. From their respective sheaves, the ends of the cables extend from opposite directions toward and are attached to the counterweight. Depending upon the direction of rotation of the racking drum, the counterweight is selectively moved in one direction or the other. The motion of the counterweight is, in turn, transmitted to the load trolley, as hereinafter explained, but in a direction opposite the direction of travel of the counterweight.

There are two shuttle trolleys on the same track as the load trolley, one of which is interposed between the load trolley and the outer end of the track of one cantilever structure, and the other of which is interposed between the load trolley and the outer end of the track on the other cantilever structure. When the counterweight is at its limit of travel on one cantilever, the load trolley is at the outer limit of its travel on the other cantilever and close to or even against the shuttle trolley between it and the outer end of the track. At this time, the other shuttle trolley will be at or near the center of the tower.

A cable attached to the counterweight passes over one or more guide sheaves at the end of the cantilever nearest which the load trolley may at that time be located, then over a sheave on the shuttle trolley at said end and then dead-ended or anchored at the outer end of the same cantilever. A second cable attached to the counterweight is guided over a sheave or sheaves on the outer end of the other cantilever on which the counterweight is then positioned, then extended toward the center of the tower to pass around a sheave on the second shuttle trolley and then extends in the reverse direction to the outer end of and is anchored to the outer end of the other cantilever structure.

As thus arranged, if the counterweight is moved in a direction toward the load trolley, the shuttle trolley on the same cantilever will be pulled from a position then near the center of the tower toward the free end of the cantilever to which its cable is anchored but, because of the sheave arrangement, at only half the speed of the counterweight and half the distance. A compensating cable arrangement, having a cable section anchored at one end to a fixed location on one cantilever structure and then extending around a sheave on the shuttle trolley and then reversed, is connected at its other end to the load trolley. There is a compensating second cable section extension attached to the load trolley which extends to and around a sheave on the other shuttle trolley and then has a reversed reach that terminates at a take-up drum. This prevents slack from developing in the cable sections.

The result is that both shuttle trolleys move at half the speed and half the distance that the counterweight moves but always remain the same distance from each other while the load carrying trolley approaches one shuttle trolley and recedes from the other but travels the same distance at the same speed as the counterweight but in the opposite direction. This results in a further important advantage.

Commonly cranes of this type have a clamshell or like bucket suspended from the load carriage by the two cables—or two pairs of cables that function as a single cable and hereinafter, for simplification, referred to as single cables. One is for opening and closing the bucket and one is for raising and lowering the bucket or holding it against vertical movement. The former is termed in the art as the "close" cable and the latter as the "hold" cable. By reeving one of these cables, for example the hold cable, from the bucket over a sheave on the load trolley and then over a sheave on one of the shuttle trolleys, and then guiding it to a power driven "hold" drum at the machinery house and the other of said two cables, the "close" cable, over a sheave on the load trolley and around a sheave on the other shuttle trolley, and then guiding it to a power driven close drum, neither the hold nor close drum need be operated as the load trolley is moved along its track because, since the distance between the two shuttle trolleys never changes even though the distance between the load trolley and the two shuttle trolleys does change. Therefore, as the lower reach of the cable between the sheave on the load trolley may increase or decrease, the upper reach will decrease if the lower reach increases, and vice versa; therefore, they will not change relation in the vertical distance or tension on the cables from the load trolley to the bucket or other load.

A preferred embodiment of the invention is disclosed in the accompanying drawings, but because of the size of the apparatus and the resulting small scale of the drawings, the drawings are generally schematic and different parts may be out of proportion.

Figures 2, 3:
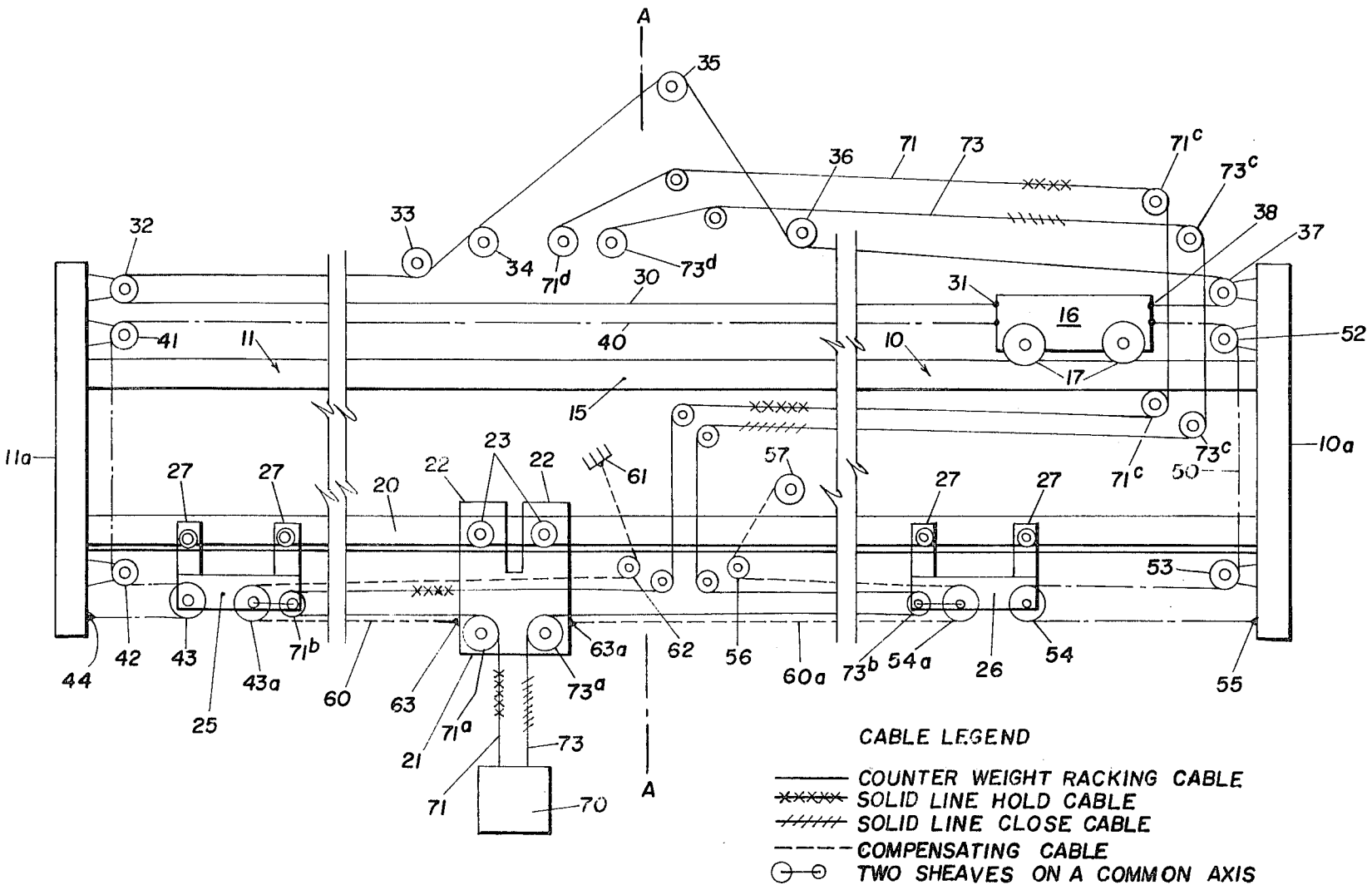
FIG. 2 is a schematic view of the entire cable system except that intermediate sections of the length are broken away for clarity of illustration, and also in some cases there may be parallel cables functioning together as a single cable and are here diagramed as a single cable, also for clarity.

FIG. 3, marked "Legend," is for the purpose of indicating how, in FIG. 2, different cables may be more easily distinguished and followed.

Figure 1:
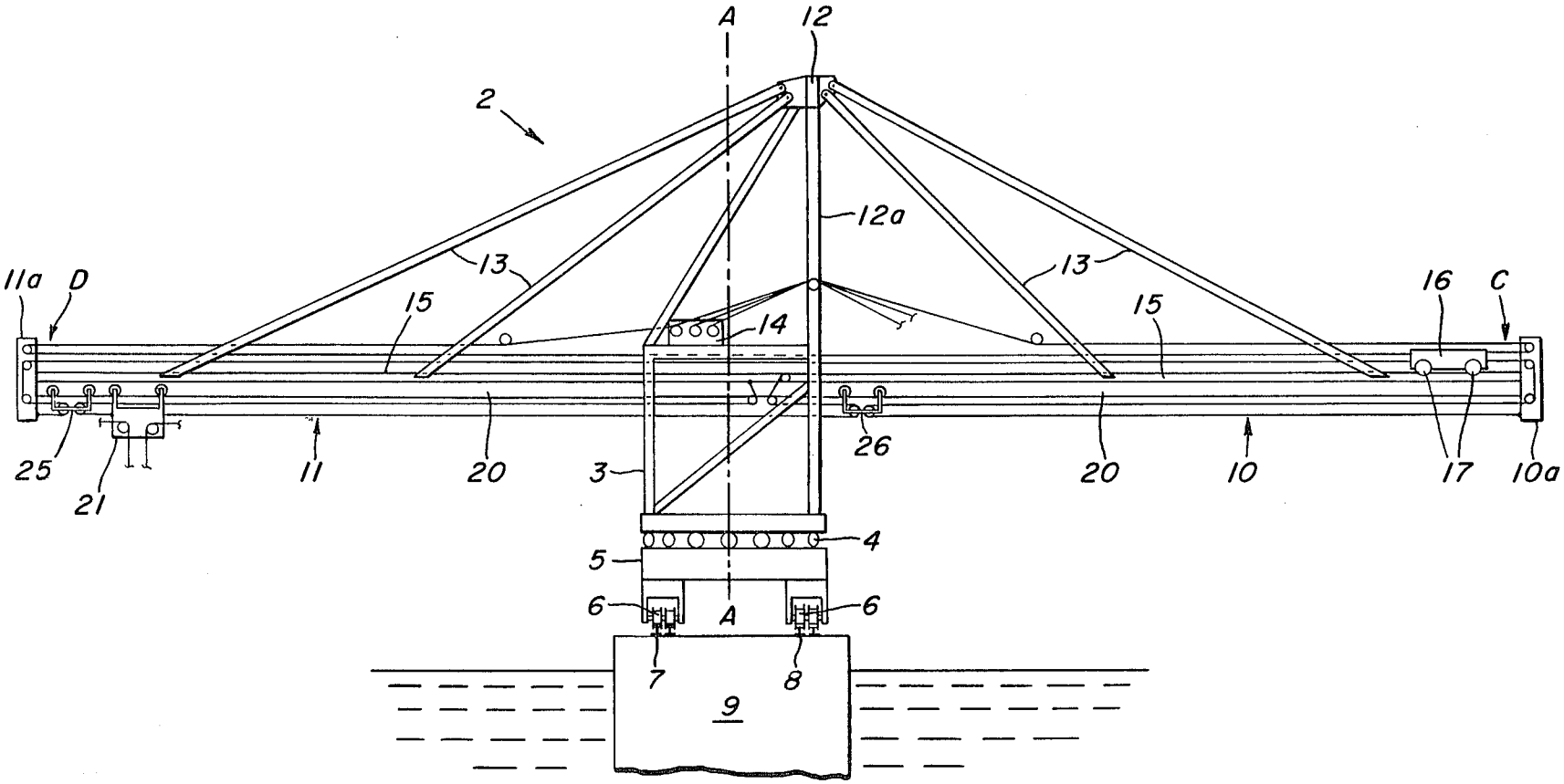
FIG. 1 is a side elevation of the structure on a small scale with little detail relevant to the invention being shown.

Referring to the drawings, and first to FIG. 1, the number 2 designates generally the hammerhead crane, 3 is the structural tower on a bearing 4 so that the tower may turn or slew about a vertical axis, indicated by the broken line A—A. The bearing 4 is generally supported on a gantry 5 with wheels 6 on tracks 7 and 8 extending along a dock or quay 9, or the like, here indicated to be an elongated dock structure where the ocean, for example, is on the left and a protected slip or lagoon is at the right, but this is merely illustrative of one environment in which the structure may be used. A ship to be unloaded or loaded may be tied up along the ocean side of the dock and a barge may be brought alongside in the lagoon. As is usual in constructions of this kind, the gantry is provided with rail clamps, not shown, by means of which it may be held fixed at one position along the tracks and then, upon release of the clamp, shifted to and releasably fixed to another.

Near the top of the tower 3 there are laterally extending opposed structural cantilevers or arms 10 and 11, the arm 10 extending to the right in the drawing being on the ocean side being sometimes termed herein the "outer" cantilever and the one marked 11 on the "lagoon" side, sometimes termed the "inner" cantilever, since in many areas of use there may be neither an ocean nor a lagoon, but perhaps there may be a storage area at the inner end and a river under the outer end for the unloading of river barges, or the apparatus located and used elsewhere.

The necessarily small scale of the drawings gives little idea of the actual massive size of the crane, but for purposes of better comprehending the magnitude of the structure, the distance from point D at the free end of the inner cantilever to the point C at the free end of the outer cantilever in the work drawing of the structure from which the patent drawings were prepared is of the order of 600 feet, or 183 meters. This is the maximum distance of travel of the load carrying trolley from the outermost limit of its travel on the inner arm to the outermost limit of its travel on the outer arm. To justify a structure of this magnitude, the loading, bucket raising, traversing, or racking from one extremity to the other, lowering and dumping, as for example the transfer of bulk materials as coal or grain, and return to start the next cycle, must take place at relatively high speed.

The tower has a vertical mast 12 formed of converging members 12*a*, these being here shown as extensions of the two vertical legs at the right of the tower in FIG. 1. There are various diagonal hangers 13 extending from the top of this mast to each of the two cantilever arms. There is a machinery house 14 in the top of the tower, and it is common to have an operator's cab (not here shown) at some place along the length of the two arms and which may be a traveling cab.

As more clearly seen in FIG. 2, there is a continuous upper track 15 for the counterweight. It extends from the free end of the outer cantilever 10 through the tower below the machinery house 14 to the free end of the inner cantilever 11. The counterweight 16 has flanged wheels 17 that roll on the track and which are guided by the track so that the counterweight may travel almost the full length of the track. In FIG. 2, the counterweight 16 is shown at an intermediate position to the right of the center, but spaced inward from the outermost limit of its travel.

There is a second track 20 below the track 15 extending from the free end of the outer cantilever through the tower to the free end of the inner cantilever and which, as seen in FIG. 2, appears as a single rail but usually comprises spaced parallel side-by-side rails, and, of course, the track 15 could likewise comprise parallel rails. A main load carrying trolley 21, also called the "load trolley," has a pair of vertically extending arms 22 with rolls or wheels 23 at the top guided on the track or rail 20 which is spaced below the track 15 for the counterweight. The details of such trolley suspension are well known and may vary widely as a designer may choose and, therefore, have been omitted.

The load carrying trolley 21 is between first and second shuttle trolleys 25 and 26, these being here shown to the left and right respectively of the load carrying trolley 21. Each shuttle trolley is of like construction with two spaced pairs of arms 27, each arm having rollers thereon by which the respective shuttle trolleys are movably suspended from and travel along the track 20, as does the main trolley. The first shuttle trolley 25 is on the inner cantilever between the load trolley and the free end of the said cantilever. The second shuttle trolley 26 also moves along the lower track, but only over the length of said track between the free end of the outer cantilever and toward, but not quite to, the center line of the tower.

The operation of the cable system insofar as it has been described may now be explained. Referring to FIG. 2, there is a cable 30 for racking the counterweight. It is attached at 31 to the left end of the counterweight 16. This cable extends to the left or free end of cantilever 11, where it passes around a sheave 32 and then extends in the opposite direction until it passes under guide sheave 33, and from this sheave it slopes upwardly to racking drum 34 in the machinery house. It wraps around drum 34 for a few turns, and then passes over sheave 35. Leaving sheave 35, it passes under sheave 36, whence it extends horizontally to sheave 37 at the free end 10 of the outer cantilever and about which it is guided to extend in the opposite direction with its other end attached to the right end of the counterweight 16 at 38. Thus the counterweight and cable 30 which, as previously indicated, may actually consist of two separate cables, the drum ends of which wind or unwind from the counterweight racking drum, comprise a closed loop and, when the rack drum 34 is rotated in one direction, it will move the counterweight to the left, and, rotated in the other direction, it will move the counterweight to the right.

Assuming that the counterweight in FIG. 2 is traveling toward the left, the load trolley 21 moves at the same speed toward the right so that a fairly balanced relation will exist at all times along the load track with respect to the vertical axis of the tower. Both move simultaneously toward the vertical center of the tower or outward toward the opposite ends, depending on the direction in which the racking drum is turning. A fixed end structure of the cantilever 11 is indicated as 11*a* in FIG. 2. For moving the load trolley, a supplemental first racking cable 40 is attached to the left end of the counterweight. It extends horizontally to the free end of the inner cantilever where it passes over upper and lower sheaves 41 and 42. It then extends in the reverse direction and passes around sheaves 43 at the left end of the first shuttle trolley 25 and then extends again toward the left to dead-end at 44 on the free or left end 11*a* of the inner cantilever.

There is a second supplemental racking cable 50 attached to the right end of the counterweight and it extends around sheaves 52 and 53 at the free end of the outer cantilever and then extends horizontally to the left and is looped around sheave 54 of the second supplemental or shuttle trolley 26. From sheave 54 it then extends outwardly to the right end 10*a* of the outer cantilever structure where it dead-ends at 55.

Thus, as the counterweight 16 moves to the left, it pulls cable 50 with it, causing supplemental or shuttle trolley 26 to move to the right but, again, at half the distance and half the speed of the counterweight.

As this takes place, slack could develop in cable 40 under certain conditions, except that there is a compensating cable having a section 60 which dead-ends at 61 in the tower and which is guided around fixed sheave 62 and extends horizontally to the left to pass around sheave 43*a* of the first shuttle trolley 25 and is anchored to the main trolley at 63. A separate section 60*a* of the compensating cable is attached at 63*a* to the main trolley. It extends horizontally to the right and passes around sheave 54*a* of the second supplemental or shuttle trolley 26 and is then guided around sheave 56 near the midpoint of the full length of the track on which the several trolleys move and anchored to a constant tension slack take-up unit, here indicated as a drum 57.

With this arrangement, as the counterweight 16 moves to the left, shuttle trolley 26 is pulled to the right but at half the speed and also half the distance. At the same time, cable section 60*a*, passing around sheave 54*a* but without necessarily any operation of the take-up drum 57, pulls the load trolley 21 to the right at the same speed and for the same distance that the counterweight moves to the left. At the same time, compensating cable section 60 pulls the shuttle trolley 25 to the right but at half the speed and half the distance that the main trolley moves. This, of course, keeps the line 40 taut. In other words, the pulling of lines 50 and 60*a* as the counterweight moves to the left, with the corresponding movement of the counterweight to the left, provides for a cumulative movement of the load trolley to the right at twice the speed of the supplemental trolleys. By the time the counterweight reaches its outward limit of travel on cantilever 11, the load trolley will be close to the supplemental trolley 26 at the outer limit of travel of the cantilever 10. Thus, it will be seen that, as the supplemental trolley 26 reaches the outer end of the cantilever, it will be overtaken by the main trolley 21 which will then be adjacent to shuttle trolley 26 and can then move no further. At the time the load trolley will have reached the outermost limit of its travel, the first supplemental trolley 25 will have moved toward the middle of the track, but never past the sheave 62, and the distance between the two supplemental trolleys will remain constant.

The load is schematically indicated at 70. Commonly, it will comprise a clamshell or similar bucket for loading or unloading bulk material. Assuming it to be such a bucket, it will be suspended from the load trolley by a cable system or, more likely, a pair of cables functioning as a single cable and hereinafter shown and described as a single cable, and also by a second cable system, also generally comprising a pair of cables functioning as a single cable and here shown and described as a single cable. The first of the above cables, 71, is herein designated, as is usual in the art, as the "hold" cable. Its function is to raise and lower the bucket or keep it suspended at a fixed distance below the load trolley when that trolley is moving along its track, and the other cable 72 is designated as the "close" cable and its function is to close the bucket after the bucket is loaded and to open the bucket when the load in the bucket is to be gathered or discharged.

The hold cable 71 extends upwardly from the bucket over a sheave 71*a* on the load trolley, then horizontally toward the left, as here illustrated, and around sheave 71*b* on the shuttle trolley 25, which is here schematically shown as being on the same axis but behind sheave 43*a*, each sheave being free to turn independently of the other. From sheave 71*b* the cable 71 returns toward the right and is then reeved over or around the several sheaves, including 71*c* at the right end of the right cantilever, and then turns back to the machinery house and hold drum 71*d*.

Likewise, the close cable 73 connected to the load 70 passes upwardly and over sheave 73*a* on the load trolley and then to the right around sheave 73*b* on the second shuttle trolley and then around several guide sheaves including sheave 73*c* at the outer end 10 of the right cantilever. As here illustrated, the close cable extends to the left and is guided to power-driven close cable drum 73*d* at the machinery house. It may here be explained that the hold and close cables could just as well be interchanged and the two power-driven cable drums interchanged. As a matter of fact, where two hold cables and two close cables are used, as is commonly the case, a hold and close cable may be parallel throughout until they are finally guided to their respective power-driven drums. For simplicity and clarification, such parallel cable arrangement is not shown in the drawing but is an expedient used to keep the load, which is then suspended from the load trolley by four cables, from twisting.

By reason of the fact that the shuttle trolleys travel only half as fast and half as far as the load trolley, the load trolley may move back and forth between its limit of travel at the opposite ends of the track without requiring any operation of the load hold or close drums to keep the tension on the hold or close cables constant, i.e., no change in the overall lengths of these cables takes place to either produce slack or increase tension as the load trolley and bucket or other suspended load is carried in one direction or the other. Also, the operator may maneuver the load up or down or, if it is a bucket, open or close it at will in any position at which he may desire without changing the position of the load trolley, or even while the load trolley is moving, should this at times be desirable.

It should perhaps be pointed out that, in the parlance of the industry, the terms "lines" and "cables" may be interchangeably used to mean the same thing, unless by context some specific difference is indicated. Also, the trolleys 21 and 26 may both be interchangeably termed "shuttle" trolleys or "supplemental" trolleys.

We claim:

1. A hammerhead crane having a vertical tower with a pair of horizontal parallel spaced continuous members extending through said tower near the top thereof, said members defining pairs of cantilevered tracks that extend laterally from the vertical center of said tower, said cantilevered tracks including a fixed end structure at each end thereof with a plurality of sheaves mounted thereon comprising:

(a) a counterweight movably mounted on a first one of said tracks, a drum, cable means extending from said drum and attached to said counterweight to selectively move same between the ends of said first track;

(b) a load trolley movable along a second one of said tracks;

(c) a first and second shuttle trolley movably mounted on said second track and movable along said second track between a respective outer end and the middle portion of said second track, the range of travel of each shuttle trolley being one-half the total range of travel of said load trolley, a plurality of sheaves mounted on each of said shuttle trolleys;

(d) a first cable attached at one end to said counterweight and reeved about sheaves on one of said fixed end structure and then toward said tower and about a sheave on said first shuttle trolley, and then anchored to one of said fixed end structure;

(e) a second cable attached at one end to said counterweight and reeved about sheaves on the other one of said fixed end structure and then toward said tower and about a sheave on said second trolley, and then anchored to said other one of said fixed end structure;

(f) compensating cable means attached to said tower and operatively connecting each of said first and second shuttle trolleys with said load trolley, the arrangement of said drum, cable means, compensating cable means, first and second cables being such that when said counterweight is moved in one direction along said first track, said shuttle trolleys will move along said second track in an opposite direction at half the speed of said counterweight and said load trolley will move along said second track at the same speed as said counterweight.

2. The hammerhead crane as defined in claim 1 wherein said compensating cable means comprises a first cable section attached to the load trolley and then reeved about a sheave on the first shuttle trolley and extends reversely toward the tower but clear of the load trolley to guiding and fixed anchoring means on the tower, and a second cable section attached to the load trolley and which extends toward the tower and which passes around a sheave on the second shuttle trolley and which then extends toward the tower around guiding means to anchor means on the tower.

3. The hammerhead crane as defined in claim 2 wherein the anchoring means on the tower for one of said cable sections comprises a slack take-up means to keep the compensating cable taut during operation of the trolley system.

4. The hammerhead crane as defined in claim 1 wherein the load trolley is on the same track as the shuttle trolleys and is located between the counterweight and the shuttle trolleys with the compensating cable reeved to result in the shuttle trolleys moving at half the linear speed of the counterweight but in the opposite direction while effecting travel of the load trolley in a direction also opposite the direction of travel of the counterweight but at the same linear speed as the counterweight.

5. A hammerhead crane as defined in claim 4 in which the load trolley has a load suspended therefrom by at least two cables, the first of which is attached to the load, then over a sheave on the load trolley to a sheave on the first shuttle trolley, and from which it is reeved in the reverse direction toward the center of the tower and then around a fixed sheave near but beyond the inner limit of travel of said second shuttle trolley, being then guided to a fixed power-driven drum about which it selectively winds or unwinds, and the other of said cables similarly has one end attached to the load from which it extends over a sheave on the load trolley and passes around a sheave on the second shuttle trolley, then toward the tower to a fixed sheave near but beyond the inner limit of travel of the second shuttle trolley in its travel toward the center of the tower and from said last-named sheave, and it is then guided to a second fixed power-driven drum about which it also selectively winds and unwinds.

6. The overhead crane as defined in claim 5 in which the load trolley is positioned on the same track as the shuttle trolleys and is located between them, one of the sheaves on each shuttle trolley providing a guide for a separate racking cable section for each shuttle trolley, one end of the respective racking cable sections passing around said one sheave by which it is guided and then anchored to that end member which is the closer to it, the other end of each cable section being guided around sheave means on the same respective end member to which its racking cable section is anchored and which has its respective terminals attached to the counterweight, whereby when the counterweight travels along its track, the respective cable sections effect movement of the shuttle trolleys along their track, one at each side of the load trolley and in the direction opposite to the direction of travel of the counterweight, and a compensating cable system attached to the load trolley, reeved about sheaves on the respective shuttle trolleys and then anchored at the tower and which, by said reeving about the shuttle trolleys, is racked at a speed equal to the speed of the counterweight but in the same direction as the shuttle trolleys, and a power driven drum cable system for selectively moving the counterweight back and forth along its track whereby but one reversable powered cable system is required to effect the travel of the counterweight, the shuttle trolleys and the load trolley at the speed differential and direction differences specified and by which the load trolley is held against movement when the counterweight is stationary.

7. A hammerhead crane as defined in claim 5 in which one of said cables and its power-driven drum is a hold cable for raising, lowering, or holding the load at a selected distance below the load trolley and the other cable and its power driven drum is a close cable for gathering and retaining a load and thereafter releasing it.

8. A hammerhead crane as defined in claim 7 in which each of said cables comprises at least one pair of cables functioning as a single cable.

9. The hammerhead crane as defined in claim 1 wherein said compensating cable system has two cable sections, each of which has an end fixed to the load trolley but extending in opposite directions therefrom, each shuttle trolley having a sheave thereon with one of said compensating cable sections extending from the load trolley about the said sheave on one shuttle trolley and then extending horizontally to an anchor fixed to the cantilever near, but removed from, the vertical center line of the tower, the other section of said compensating cable extending horizontally from the load trolley and passing around the sheave on the other shuttle trolley, and which then extends in the reverse direction toward the vertical axis of the tower, a guide sheave in the tower about which said other section next passes close to but spaced from the vertical axis of the tower and positioned above but in alignment with said second track, said last-named cable section then being operably connected with a constant tension means.

10. The hammerhead crane as defined in claim 9 in which said compensating cable system constitutes means for traversing the load trolley through its full length of travel corresponding to but in a direction of travel opposite that of the counterweight, and each shuttle trolley moves only half the same distance but in the same direction as the load trolley.

11. The hammerhead crane as defined in claim 9 in which the first track is spaced above the second one a distance sufficient for the counterweight and load trolleys to freely pass, each in the opposite paths of travel, along their respective tracks.

* * * * *